US006580781B2

(12) United States Patent
Bachmann et al.

(10) Patent No.: US 6,580,781 B2
(45) Date of Patent: Jun. 17, 2003

(54) METHOD OF MANUFACTURING A WINDOW TRANSPARENT TO ELECTRON RAYS, AND WINDOW TRANSPARENT TO ELECTRON RAYS

(75) Inventors: Peter Klaus Bachmann, Wuerselen (DE); Manfred Beckmann, Aachen (DE); Peter Flisikowski, Vaals (NL); Geoffrey Harding, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/973,310

(22) Filed: Oct. 9, 2001

(65) Prior Publication Data

US 2002/0048344 A1 Apr. 25, 2002

(30) Foreign Application Priority Data

Oct. 13, 2000 (DE) ..... 100 50 810

(51) Int. Cl.[7] ..... G21K 1/00
(52) U.S. Cl. ..... 378/161; 378/143; 378/140
(58) Field of Search ..... 378/161, 140, 378/143

(56) References Cited

U.S. PATENT DOCUMENTS 5,173,612 A * 12/1992 Imai et al. ..... 378/161
5,305,364 A * 4/1994 Mochiji et al. ..... 378/161

FOREIGN PATENT DOCUMENTS

DE 19821939 11/1999 ..... H01J/35/12

* cited by examiner

*Primary Examiner*—Craig E. Church
(74) *Attorney, Agent, or Firm*—John Vodopia

(57) ABSTRACT

A window transparent to electron rays is provided which includes a foil which is transparent to electron rays and an element for supporting a peripheral region of the foil in an operational state. The element is made from a material having a greater linear thermal expansion coefficient than the foil material. The window transparent includes an intermediate layer between the foil and a retaining element. The retaining element acts as a support element and consists of a material having a linear thermal expansion coefficient which is equal or similar to the linear thermal expansion coefficient of the foil material and smaller than the linear thermal expansion coefficient of the material of the retaining element over a processing temperature range. A method of manufacturing a window which is transparent to electrons and an X-ray device with a window transparent to electrons are also provided.

14 Claims, 2 Drawing Sheets

METHOD OF MANUFACTURING A WINDOW TRANSPARENT TO ELECTRON RAYS, AND WINDOW TRANSPARENT TO ELECTRON RAYS

BACKGROUND OF THE INVENTION

The invention relates to a method of manufacturing a window transparent to electron rays as well as to a window transparent to electron rays comprising a foil which is transparent to electron rays and an element for supporting a peripheral region of the foil transparent to electron rays in the operational state, which element is made from a material having a greater linear thermal expansion coefficient than the foil material. The invention further relates to an X-ray device fitted with such a window.

Such windows transparent to electron rays are used wherever sensitive objects are to be screened off from external conditions while still a sufficient transparency for the passage of the electron ray is to be safeguarded. The use of such windows in an X-ray tube with a metal target, also denoted LIMAX X-ray tube (LIMAX=Liquid Metal Anode X-ray tube), is proposed in DE 198 21 939 A1. Such an X-ray device basically consists of an electron source and a target of liquid metal which circulates in the operational condition of the radiation device. The liquid metal is present in a pump circulation system and is pumped into a receiver container via a special steel plate by means of a distribution head. The electron ray hits the liquid metal flowing over the special steel plate and generates X-radiation therein. It is achieved by means of the window that the vacuum space of the electron source and the target are separated from one another into two independent spaces, so that the target becomes less sensitive to the flow characteristics and the type of liquid metal chosen. Such a window comprises, for example, a 1 $\mu$m thick diamond layer vapor-deposited on a silicon carrier substrate in a CVD process, from which then the carrier substrate is partly or wholly removed for creating a window or transmission zone. The window thus constructed is directly mounted in the X-ray tube.

It was found that windows manufactured in this way are not resistant to pressure differences of more than 4 bar such as they occur, for example, in a LIMAX X-ray tube in accordance with DE 198 21 939 A1, because at higher pressure differences the diamond film is torn from the carrier substrate, which at the same time serves as a retaining element, so that the window is destroyed. The bursting pressure is reached in particular during the starting phase of tube operation in the case of LIMAX tubes, when pressure differences of more than 4 bar occur.

SUMMARY OF THE INVENTION

The invention has for its object to provide a method of manufacturing a window transparent to electron rays as well as a window transparent to electron rays wherein the disadvantages mentioned above do not arise.

This object is achieved by means of a method of the kind mentioned in the opening paragraph in that a foil transparent to electron rays is manufactured, preferably having a thickness smaller than 10 $\mu$m and more preferably smaller than 5 $\mu$m, and in that said foil is connected to the retaining element via an intermediate layer consisting of a material having a linear thermal expansion coefficient equal or similar to the linear thermal expansion coefficient of the material of the foil and smaller than the linear thermal expansion coefficient of the material of the retaining element, seen over the processing temperature range, and in that the intermediate layer forms a buffer for the difference in thermal expansion characteristics between the retaining element and the foil during the joining process.

A window with a foil of high mechanical robustness is achieved by this joining technique, said foil being fixedly connected to the retaining element, which positively influences the operational life of the window as well as its loading limits.

In principle, the proposed method is suitable also for joining the foil to the retaining element at room temperature, but it only provides its specific advantages in joining processes under heat supply, for example soldering with soldering or joining temperatures of >100° C., usually 400–900° C. Joining of the foil to the retaining element by way of the interposed protective intermediate layer, i.e. via a stress buffer, avoids that the foil upon cooling down is deformed or folded owing to the shrinking action of the retaining element caused by its greater linear thermal expansion coefficient. The planar thin foil or window surface which is not or substantially not deformed leads to a reduction or total elimination of hydrodynamic dead water zones when the window according to the invention is introduced into flowing media, which is of particular benefit for the cooling properties of the window for fluids to be cooled which flow past the window surface. The window thus manufactured and constructed is suitable for use as a separation means in overpressure or underpressure chambers, in particular for pressure differences of more than 0.1 bar, more in particular above 5 bar, or alternatively as a separation means for chambers having different contents such as gases or fluids of different compositions.

The manufacture according to the invention may take place in a single-step process or a two-step process. In the former embodiment of the method, the foil transparent to electron rays, the intermediate layer, and the retaining element are joined together in a single collective step. In the latter embodiment of the method, the foil transparent to electron rays is connected to the intermediate layer in a first step so as to obtain a layer package, and in a subsequent second step this layer package is joined to the retaining element.

The connection itself is achieved by means of suitable adhesion or fusion layers. Eligible fusion processes are all known processes, in particular fusion by means of an active metal solder or glass fusion. Adhesive bonding layers, in particular heat-activated glue layers, or alternatively combined glue-fusion layers are also possible. Preferably, ceramic glues (for example, marketed by the Aremco Company) should also be used. The processing temperatures are then to be chosen in dependence on the adhesion and fusion substances used, lying, for example, between room temperature and the fusion temperature of, for example, the active solder.

In a preferred embodiment, it is suggested that the thin foil transparent to electron rays is connected to an intermediate layer whose thickness is equal to, or preferably greater than the thickness of the foil so as to obtain a layer package of greater rigidity, which layer package is connected to the retaining element via a connecting layer (adhesion or fusion layer).

The thin foil is stabilized over the intermediate layer in a first step, and the connection to the retaining element, whose coefficient of thermal expansion is greater than that of the material of the foil transparent to electron rays, then takes place by way of this intermediate layer or layer package.

Said thicker intermediate layer or layer package absorbs a major portion of the stresses arising from the differences in expansion coefficient on account of its greater rigidity and thus protects the thin foil transparent to electron rays.

In a further embodiment it is proposed that the foil transparent to electron rays is connected to a first partial intermediate layer and subsequently to at least a second partial intermediate layer. It is alternatively possible that first the intermediate layer comprising at least two partial intermediate layers is manufactured, which is then joined to the foil transparent to electron rays. Generally, a layer stack is manufactured first each time and is subsequently joined to the retaining element.

It should be noted here that a vacuum separation window transmitting light rays, i.e. a window of a different kind, is known from DE 43 01 146 A1, wherein the light comprises an X-ray, infrared, visible, and ultraviolet radiation. The vacuum window consists of a thin layer transmitting the radiation with a carrier element which supports this thin layer. Between the thin layer and the carrier element there is a layer by means of which the stresses acting on the thin layer are reduced, i.e. stresses which have arisen owing to differences in coefficients of thermal expansion of the materials of the carrier element and the thin layer not during the manufacturing process, but during the heat treatment for achieving an ultra-high vacuum (thermal drying). This intermediate layer is to be composed of a metal or an alloy which produces a liquid in that temperature range which corresponds to the operating temperature. In particular, gallium, a gallium-indium alloy, and a gallium-tin alloy are suggested as the liquid metal or liquid alloy for this intermediate layer, having a sufficient viscosity and surface tension and in addition a low vapor pressure. In contrast thereto, the intermediate layer proposed by the present invention is solid in the operational state.

According to the invention, the peripheral region, i.e. the edges, of the foil transparent to electron rays is connected to the retaining element via the intermediate layer, the latter as well as the former being provided with an opening, i.e. being, for example, annular in shape. It is not absolutely necessary here that the edges of the intermediate layer or partial intermediate layers adjoining the transmission zone for the electron ray are formed perpendicular to the longitudinal axis of the foil, they may also have sloping or curved edge shapes. It is also conceivable in principle that the intermediate layer is transparent to electron rays together with the foil and extends over the surface as does the foil.

According to the invention, a window transparent to electron rays of the type indicated is further formed with an intermediate layer which consists of a material having a linear thermal expansion coefficient which is equal or similar to, preferably greater than, the linear thermal expansion coefficient of the foil material and smaller than the linear thermal expansion coefficient of the material of the retaining element, seen over the relevant processing temperature range.

Preferably, the foil transparent to electron rays is made of diamond with a thickness of no more than 10 $\mu$m. In an advantageous embodiment, the foil may alternatively be made of molybdenum, which may be as thin as 3 $\mu$m, or of beryllium.

In the case of a diamond foil, the material of the intermediate layer has a linear thermal expansion coefficient smaller than $5\times10^{-6}$/K; and preferably the linear thermal expansion coefficient should be at most four times the linear thermal expansion coefficient of diamond, which lies at approximately 0.5 to $1\times10^{-6}$/K. The linear thermal expansion coefficient of ideal diamond as a monocrystal lies at $0.5\times10^{-6}$/K, which coefficient rises to a value of up to $1\times10^{-6}$/K in the manufacture by a CVD process and the accompanying formation of polycrystalline material.

Suitable materials to be used for the intermediate layer in combination with matching adhesion or fusion agents are, besides diamond, particularly quartz glass, silicon, $Si_3N_4$, $SiO_2$, SiC, as well as industrial tool ceramics of low thermal expansion coefficient between 1.5 and $2\times10^{-6}$/K such as, for example, SiAlON. Included are also materials whose linear thermal expansion coefficient is smaller than that of in particular technically manufactured diamond. Preferred materials for the retaining element are given in claim 15. All possible combinations of materials for the foil, the intermediate layer, and the retaining element are conceivable and form part of the invention.

The intermediate layer provided in accordance with the invention should have a thickness equal to or greater than the foil thickness. The thickness preferably lies in a region between the values of 5 and 5000 $\mu$m.

To buffer the heat-induced stresses better in the bridging zone formed by the intermediate layer, it is advantageous to subdivide the intermediate layer into partial intermediate layers and to provide at least one of the partial intermediate layers with a cooling element. Such a cooling element may be, for example, a cooling channel which is provided in the layer by means of a laser. Cooling liquids which may be used are water, oil, liquid metals, etc.. If the window transparent to electron rays is used in a LIMAX X-ray device, the cooling channel may advantageously be incorporated into the cooling circulation system thereof.

It is advisable in the case of a diamond foil to reduce the electrical resistance of the diamond, in particular of the diamond foil transparent to radiation, through doping, for example with boron, so as to reduce or avoid a deflection of the electron ray.

Furthermore, the thickness of the diamond foil transparent to electron rays should comply with:

window thickness ($\mu$m)>0.7 L (cm)×$\Delta$p (bar), with $\Delta$p (bar) being the pressure difference between the two window sides and L being the greatest longitudinal dimension of the window opening, i.e. L being the diameter in the case of circular openings, the major axis in the case of elliptical openings, and the longest side in the case of rectangular openings.

BRIEF DESCRIPTION OF THE DRAWINGS

Further particulars and advantages of the invention will become apparent from the ensuing description in which the embodiments of the invention shown in the Figures are explained in more detail. Besides the combinations of characteristics given above, individual characteristics or other combinations of characteristics are also part of the invention. In the diagrammatic drawings.

DETAILED DESCRIPTION OF THE PREFERRED EMBODIMENTS

Figure 1:
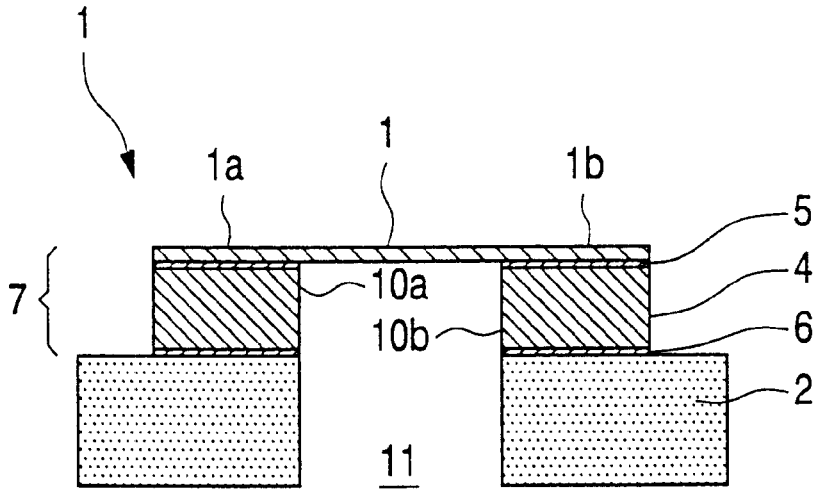
FIG. 1 is a cross-sectional view of an embodiment of the window transparent to electron rays according to the invention.

FIG. 1 shows a window 3 built up from a diamond foil 1 and a separate, annular retaining element 2 in cross-section.

In the embodiment shown, the thin diamond foil 1 transparent to electron rays is joined to the retaining element 2 by means of a single intermediate layer 4, made of diamond in this case. The intermediate layer 4 has a greater thickness than the diamond foil 1, which may be up to 10 μm thick. The bonding layers 5 and 6 are either glue or fusion layers. The material of the retaining element 2 is characterized in that it is a heat-resistant material, preferably a metal, for example aluminum, copper, molybdenum, or tungsten, or low alloys of these metals, or stainless steel. It should be noted that the retaining element 2 did not take part in the actual manufacture of the diamond foil in the capacity of a carrier substrate, indeed, it was not connected to the diamond foil until after the manufacture thereof. It should thus be noted here that a distinction is made between the concepts of a carrier substrate and a retaining element within the context of the present invention. The carrier substrate serves as a deposition surface in the manufacture of the window foil, whereas the retaining element serves as a positioning aid for the foil in the operational state.

The manufacture of thin diamond layers and of the diamond intermediate layer is known and usually takes place in a gas-phase deposition process. The thin diamond foil 1 is fully divested of the carrier substrate on which it was deposited, for example in that the carrier substrate is etched away or ground off, and is glued or fused to the diamond intermediate layer 4, also made by the above method, by its peripheral regions 1*a,* 1*b* or edge regions.

According to the invention, a single-step as well as a two-step method is proposed for manufacturing the window, i.e. for connecting it to the retaining element. In an embodiment of the former method, the foil, the intermediate layer, and the retaining element with a solder layer interposed each time are introduced into the soldering oven as an integral unit and heated to approximately 900° C. there, depending on the solder. The solder solidifies at 800° C. already during the subsequent cooling down. The components of the window, i.e. the foil, the intermediate layer and the retaining element, are fixed relative to one another by this. The retaining element will shrink strongly in relation to the diamond foil on account of its higher linear thermal expansion coefficient upon further cooling and would warp the diamond foil. The intermediate layer, however, has solidified already below 800° C. because of the solidified solder and keeps the stresses away from the foil. The shrinking action of the retaining element is absorbed by the intermediate layer, which is formed from a material with a linear thermal expansion coefficient equal or similar to that of diamond.

Alternatively, the diamond layer is glued together with the intermediate layer into a layer package referenced 7 here, which is then joined to the retaining element 2 via a glue or fusion layer 6. No or only very small stresses will arise in the thin diamond foil 1 in the joining process in spite of the necessary higher temperatures because of the equal or substantially equal coefficients of expansion. The intermediate layer 4, because of its greater rigidity, will absorb the heat stresses generated by the joining process, especially if it is thicker than the thin diamond foil transparent to electron rays, thus forming a buffer for the vulnerable, thin diamond foil 1.

Figure 2:
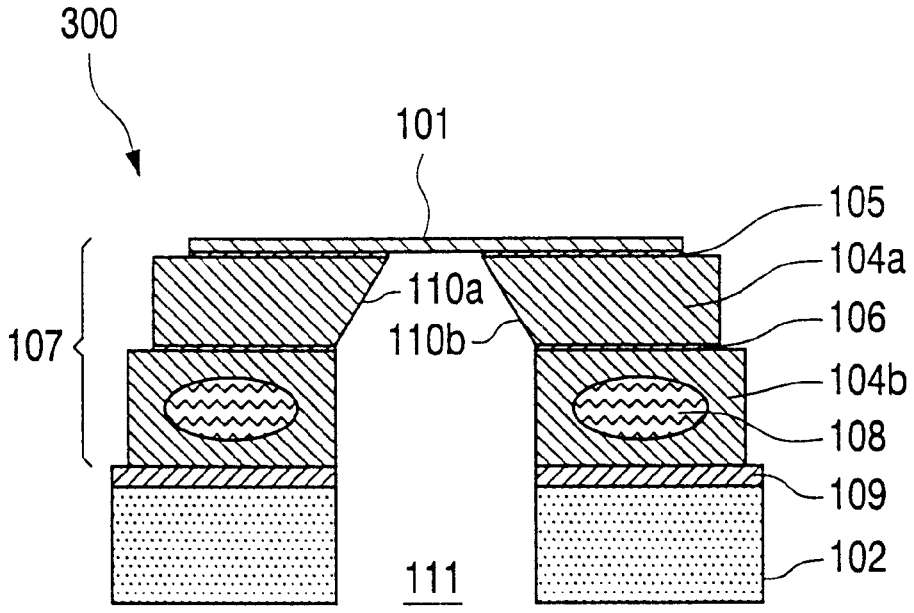
FIG. 2 is a cross-sectional view of a further development of the embodiment of FIG. 1.

In the preferred embodiment of the window 300 transparent to electron rays as shown in FIG. 2, said window is built up from, in that order, a diamond foil 101 with a thickness of less than 10 μm, preferably less than 5 μm, a first adhesion or fusion layer 105, a first partial intermediate layer 104*a* of diamond, a second adhesion or fusion layer 106, a second partial intermediate layer 104*b* of diamond with an incorporated cooling element 108, which is constructed as a cooling channel of oval cross-section traversed by a liquid, for example water or oil, and a third adhesion or fusion layer 109 which connects the second partial intermediate layer 104*b* to the retaining element 102. The two partial intermediate layers 104*a,* 104*b* together with the thin diamond foil 101 form a layer package 107 or stack. Alternatively, the single-step method described further above is also possible for this window construction.

Whereas in the embodiment of FIG. 1 the intermediate layer 4, which is annular in shape as is the retaining element 2, has edges 10*a, b* along the transmission zone 11 for the electron radiation which are perpendicular to the longitudinal axis of the diamond foil, the first partial intermediate layer 104*a* in the embodiment of FIG. 2 is constructed with beveled edges 110*a, b,* narrowing towards the transmission zone 111 for the electron radiation. The geometry of the retaining element and that of the intermediate layer are obviously not limited to an annular arrangement; all geometries having a—preferably central—opening are conceivable. The intermediate, i.e. partial intermediate, layers 104*a, b* are thicker here than the diamond foil 101, as was the case in the embodiment of FIG. 1. It is advantageous to make the adhesion and fusion connection 109 between the diamond layer stack 107 and the retaining element 102 also thicker than the connecting layers 105, 106 between the diamond layers 101, 104*a, b.*

Figure 3:
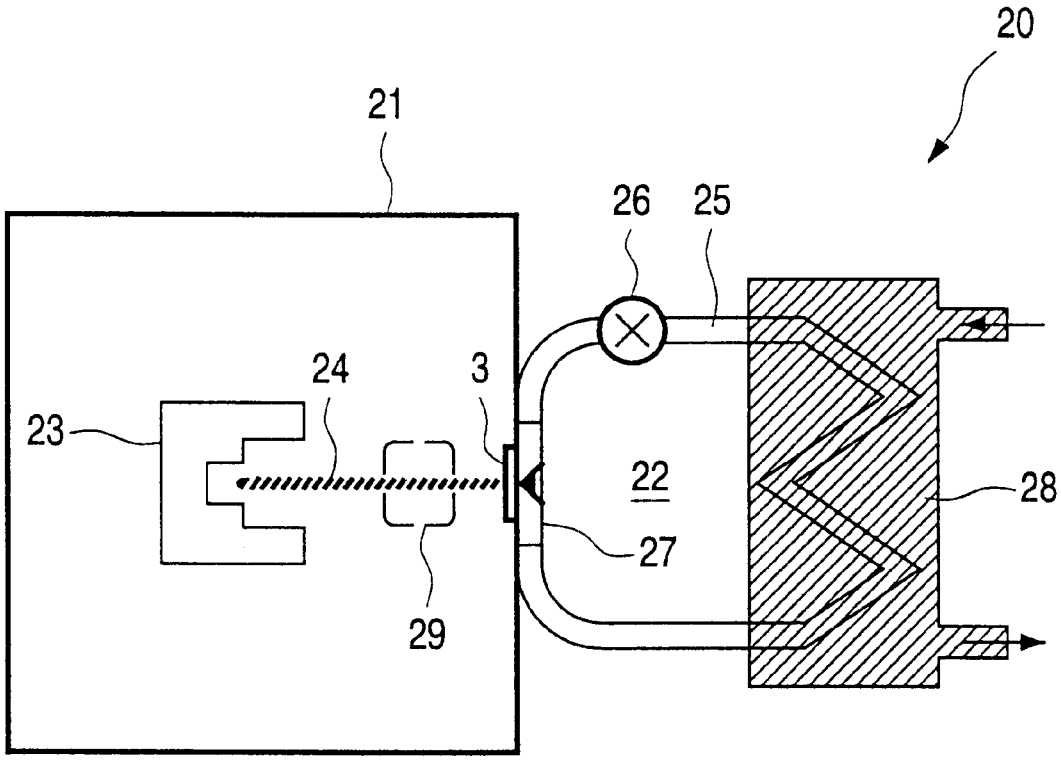
FIG. 3 shows an X-ray device with a window transparent to electron rays according to the invention.

FIG. 3 is a general picture of an X-ray device 20 operating by the LIMAX principle, in which a window 3 (shown diagrammatically) according to the invention with the further features described above may be preferably used. The X-ray device is constructed with an X-ray tube 21 and a liquid metal circulation system 22. The X-ray tube 21 is closed off in a vacuum-tight manner by means of the window 3. An electron source is present in the vacuum chamber of the X-ray tube 21 in the form of a cathode 23 which in the operational condition emits an electron ray 24 which passes through the window 3 and hits a liquid metal which is conducted over a steel plate. The liquid metal circulation system 22 is provided for this purpose and is composed of a tubular duct system 25 in which the liquid metal is propelled by a pump 26 so as to flow past the exterior of the window 3 in a region 27. After passing through the region 27 it enters a heat exchanger 28 from which the captured heat is removed by means of a suitable cooling circulation system. The interaction between the electrons passing through the window and the liquid metal generates X-radiation (i.e. the liquid metal acts as a target) which issues to the exterior through the window 3 and an X-ray emission window 29 in the tube 21.

It is advisable to use a doped diamond foil, in particular if the windows proposed here are used in such X-ray devices, for preventing or reducing—by means of the conductivity thus generated—an electrostatic charging of the window during operation, which charging could lead to a deflection, deceleration, or stoppage of the electron ray. Boron is suitable for reducing the resistivity to less than 1000 ohms in a doping process.

What is claimed is:

1. A method of manufacturing a window (3, 300) transparent to electron rays comprising a foil (1; 101) which is transparent to electron rays and an element (2; 102) for supporting a peripheral region (1*a, b*) of the foil transparent to electron rays in the operational state, which element is made from a material having a greater linear thermal expansion coefficient than the foil material, characterized by the following steps:

manufacture of a foil (1; 101) transparent to electron rays, connection of said foil (1; 101) transparent to electron rays to a retaining element (2; 102) which acts as a support element via an intermediate layer (4; 104*a, b*) consisting of a material having a linear thermal expansion coefficient which is equal or similar to the linear thermal expansion coefficient of the material of the foil and smaller than the linear thermal expansion coefficient of the material of the retaining element, seen over the processing temperature range, wherein the intermediate layer (4; 104*a, b*) forms a buffer for accommodating the difference in thermal expansion characteristics between the retaining element (2; 102) and the foil (1; 101) during the joining process, wherein the foil (1; 101) and the intermediate layer (4; 104*a, b*) are one of the same materials and different materials, wherein in a first step the foil (1; 101) transparent to electron rays and the intermediate layer (4; 104*a, b*) are joined together so as to form a layer package (7;107), and in a second step said layer package is joined to the retaining element (2; 102), and wherein in a first partial intermediate layer is connected to at least a second partial intermediate layer and the latter is subsequently connected to the foil transparent to electron rays, and in that the layer package is connected to the retaining element.

2. A method of manufacturing a window transparent to electron rays as claimed in claim 1, characterized in that the foil (1; 101) transparent to electron rays, the intermediate layer (4; 104*a*, 104*b*), and the retaining element (2; 102) are connected to one another in a single step.

3. A method of manufacturing a window transparent to electron rays as claimed in claim 1, or 2, characterized in that the connection of the foil (1; 101) to the retaining element (2; 102) via the intermediate layer (4; 104*a, b*) and the interconnections of the layer package (7; 107) are effected by means of adhesion or fusion/solder layers (5; 6; 105; 106; 109).

4. A method of manufacturing a window transparent to electron rays as claimed in claim 1, characterized in that the foil (101) transparent to electron rays is connected to a first partial intermediate layer (104*a*) and subsequently to at least a second partial intermediate layer (104*b*) so as to form a layer package, and in that said layer package is connected to the retaining element.

5. A method of manufacturing a window transparent to electron rays as claimed in claim 4 characterized in that the partial intermediate layers (104*a*, 104*b*) are manufactured or processed such that they define openings of different sizes, and accordingly transmission zones (111) of different shapes or sizes, on account of their edge geometries or dimensions.

6. A window transparent to electron rays comprising a foil (1; 101) which is transparent to electron rays and an element (2; 102) for supporting a peripheral region (1*a, b*) of the foil transparent to electron rays in the operational state, which element is made from a material having a greater linear thermal expansion coefficient than the foil material, characterized by an intermediate layer (4; 104*a, b*) which is arranged between the foil (1; 101) and a retaining element (2; 102) acting as a support element and which consists of a material having a linear thermal expansion coefficient which is equal or similar to the linear thermal expansion coefficient of the foil material and smaller than the linear thermal expansion coefficient of the material of the retaining element, seen over the processing temperature range, wherein the foil (1; 101) and the intermediate layer (4; 104*a, b*) are one of the same materials and different materials and the intermediate layer (4; 104*a, b*) includes at least one partial intermediate layer (104*a*, 104*b*), and in that at least one of the partial intermediate layers includes a cooling element (108).

7. A window transparent to electron rays as claimed in claim 6, characterized in that the retaining element (2; 102) consists of a material which may be chosen from the following group of materials: metals such as molybdenum, tungsten, aluminum, copper, steel, titanium, as well as low alloys thereof, glasses, and ceramic materials.

8. A window transparent to electron rays as claimed in claim 6, characterized in that the intermediate layer (4; 104*a*, 104*b*) has a thickness which is greater than the foil thickness.

9. A window transparent to electron rays as claimed in claim 6, characterized in that the foil transparent to electron rays is made of diamond.

10. A window transparent to electron rays as claimed in claim 6, characterized in that the foil transparent to electron rays is made of molybdenum.

11. A window transparent to electron rays as claimed in claim 9, characterized in that the material of the intermediate layer has a linear thermal expansion coefficient smaller than $5\times10^{-6}$/K.

12. A window transparent to electron rays as claimed in claim 9, characterized in that it comprises:

a diamond foil (101) with a thickness smaller than 10 $\mu$m, preferably smaller than 5 $\mu$m, a first adhesion or fusion layer (105), a first partial intermediate layer of diamond (104*a*), a second adhesion or fusion layer (106), a second partial intermediate layer (104*b*) of diamond with an incorporated cooling liquid channel, and a third adhesion or fusion layer (109) connecting the second partial intermediate layer (104*b*) to the retaining element (102).

13. A window transparent to electron rays as claimed in claim 6, characterized in that the material of the intermediate layer consists of a material which may be chosen from the following group of materials: diamond, quartz glass, silicon, $Si_3N_4$, $SiO_2$, SiC, and industrial ceramic materials of low thermal expansion coefficient such as SiAlON.

14. An X-ray device with an electron source (23) for the emission of electrons and a target which emits X-ray radiation when hit by the electrons, said device is formed by a liquid metal circulating in an operational state of the X-ray device, and with a window which is transparent to electron rays arranged as a separation element between the electron source and the target, said window comprises a foil (1; 101) which is transparent to electron rays and an element (2; 102) for supporting a peripheral region (1*a, b*) of the foil transparent to electron rays in the operational state, which element is made from a material having a greater linear thermal expansion coefficient than the foil material, characterized by an intermediate layer (4; 1 04*a, b*) which is arranged between the foil (1; 101) and a retaining element (2; 102) acting as a support element and which consists of a material having a linear thermal expansion coefficient which is equal or similar to the linear thermal expansion coefficient of the foil material and smaller than the linear thermal expansion coefficient of the material of the retaining element, seen over the processing temperature range, wherein the foil (1; 101) and the intermediate layer (4; 104*a, b*) are one of the same materials and different materials and the intermediate layer (4; 104*a, b*) includes at least one partial intermediate layer (104*a*, 104*b*), and in that at least one of the partial intermediate layers includes a cooling element (108).

* * * * *